US005934168A

United States Patent [19]

Feichtinger et al.

[11] Patent Number: 5,934,168

[45] Date of Patent: Aug. 10, 1999

[54] ROPE FOR THE TAKING ALONG AND TRANSFERRING OF PAPER WEBS IN THE MANUFACTURE OF PAPER AND CARDBOARD ON PAPER MACHINES

[75] Inventors: Alois Feichtinger, Vöcklabruck; Martin Kast, Pasching; Martin Schmidinger; Georg Sonnleitner, both of Wels; Klaus Weinrotter, Vöcklaburg, all of Austria

[73] Assignee: Teufelberger Gesellschaft mbH, Wels, Austria

[21] Appl. No.: 08/859,816

[22] Filed: May 19, 1997

[30] Foreign Application Priority Data

May 20, 1996 [DE] Germany ..... 296-08-971

[51] Int. Cl.[6] ..... D04C 1/00

[52] U.S. Cl. ..... 87/8; 87/1; 87/5; 87/6; 87/9; 87/11; 87/13

[58] Field of Search ..... 87/1, 5, 6, 8, 9, 87/11, 13

[56] References Cited

U.S. PATENT DOCUMENTS

| | | | |
|---|---|---|---|
| 2,949,807 | 8/1960 | Herzog et al. | 87/8 |
| 3,035,476 | 5/1962 | Fogden | 87/6 |
| 3,078,755 | 2/1963 | Chace | 87/6 |
| 4,170,921 | 10/1979 | Repass | 87/6 |
| 4,267,631 | 5/1981 | Chase | 29/426.1 |
| 4,563,869 | 1/1986 | Stanton | 57/211 |
| 4,754,685 | 7/1988 | Kite et al. | 87/6 |
| 4,836,080 | 6/1989 | Kite et al. | 87/1 |
| 5,272,796 | 12/1993 | Nichols | 87/9 |
| 5,673,546 | 10/1997 | Abraham et al. | 87/11 |

FOREIGN PATENT DOCUMENTS

| | | |
|---|---|---|
| 367112 | 3/1963 | Austria . |
| 2505568 | 8/1975 | Germany . |
| 3513093 | 10/1986 | Germany . |
| 8909450 | 11/1990 | Germany . |
| 4035814 | 5/1992 | Germany . |

*Primary Examiner*—William Stryjewski
*Attorney, Agent, or Firm*—Dilworth & Barrese

[57] ABSTRACT

The invention relates to a rope for the taking along and transferring of paper webs in the manufacture on paper machines of paper and cardboard made from round-braided textile fiber material. In accordance with the invention, raised positions are distributed over the circumference of the rope at regular or irregular distances. The raised positions are generated by design measures such as the selection of a different multiple thread count in the different running directions and/or the use of twisted and laid fiber elements, and/or by the use of fibers with profiled fiber cross-sections and/or textured or crimped fiber yarns and or by the use of fibers with profiled fiber crosssections and/or textured or crimped fiber yarns.

24 Claims, 2 Drawing Sheets

ROPE FOR THE TAKING ALONG AND TRANSFERRING OF PAPER WEBS IN THE MANUFACTURE OF PAPER AND CARDBOARD ON PAPER MACHINES

BACKGROUND OF THE INVENTION

The invention relates to a rope for the taking along and transferring of paper webs in the manufacture on paper machines of paper and cardboard made from round-braided textile fiber material.

Ropes from braided textile fiber material are known in the most varied configurations. A rope is known for example from DE 40 35 814 A1 comprising a core and a particularly braided sheath, the core being formed with low strain, ie possessing a low stretch behavior and a high modulus of elasticity. The object of this prior art is the reduction of the relative movement between a core and a sheath surrounding it, particularly during the clamping of the rope on the sheath. The core and the sheath are formed from a number of thin polyamide fibers collected as different units of the fiber rope. The sheath is formed from a mixture of low stretching and normally stretching. The number of low stretching is particularly 17% to 25%. In this way, the stretch behavior of the sheath is reduced to such an extent that it corresponds to that of the core, by which means a relative movement due to different stretching is prevented. At the same time, however, the friction coefficients of the core and the sheath are approximated to each other. The fibers can also consist of polyethylene or polypropylene.

DE 25 05 568 A1 reveals the creation of cable structures serving as armoring for solid, elastic or easily deformed materials (eg cord for automobile tires) and possessing increased resistance to fatigue and/or wear. The basic concept here can be found in the reduction of the radial pressures or compression forces prevailing between the construction layers of a cable and between these and the core. The components of a cable, ie the core and at least one outside layer are designed in such a way that at least two successive components contacting each other radially are made from materials with different moduli of elasticity. In this way, as one component is "softer", contact areas between two components are increased and the surface pressure reduced.

AT 367 112 B relates to the increase of the service life of a rope made from aromatic polyarnide with multiple layers of rope elements laid to a rope over a core. The rope comprises a heart strand, an inner strand layer laid around the heart strand with a twist and made up of strands, an outer strand layer outwardly bounding the inner strand layer and also comprising strands possessing a twist rning parallel to the twist of the strands of the inner strand layer, and monofilament bundles positioned between the inner and outer strand layers. The heart strand and the strands of the inner and outer strand layers are comprised of monofilament bundles. In this way, the surface pressure on the guidelines is reduced resulting in an increase in the service life.

U.S. Pat. No. 4,563,869 relates to a cordage, particularly to a heavy duty marine rope, with safety features in order to save people from damage due to rope breakage. When all components of a rope break at the same time, the two separate rope pieces fly away from the point of breakage at an enormous speed thus exposing any persons in the area to a great risk. It is proposed here to make a multiple component rope, preferably from a synthetic material comprising a certain number of components with a high stretch and a certain number of components with a relatively low stretch with the quantity of the latter components being predominant. In accordance with a further development of this idea, the outer skeins of the rope possess a plurality of covering threads formed from a material with a higher wear resistance.

Finally, a method is known from DE 35 13 093 A1 for the manufacture of a gradient cable as the drive element of automobile sun roofs which is claimed to be sound-absorbent and wear resistant. With a device to perform the method, a gradient cable moved in longitudinal extension is sheathed with a flocked thread. To do this, a plate with a coil taking up the thread rotates around the centre axis of the gradient cable.

In addition to the application in the different areas described above, it is known to use so-called paper guide ropes for the taking along and transferring of paper webs in the manufacture of paper and cardboard on paper machines. These ropes normally run in rope guiding systems on one of the two long sides of a paper machine. The main object of such ropes is to clamp the formed paper web by means of a suitable rope guidance and composition and so to transport it again through the individual sections of the paper machine after start of travel or after tear-offs. The so-called paper guide ropes must meet special demands which can be summarized as follows:

- longest possible service life at running speeds of up to 2,500 m/min;
- low operating stretch of the ropes so that the limited tension ways of the rope tightening stations are sufficient without falling below the required rope tension;
- temperature, humidity and chemical resistance under the usual conditions in paper or cardboard manufacture;
- good chafmg or wear resistance towards the guiding rollers of the rope guidance systems and
- good splicing capability of the rope ends to achieve an endless rope.

In addition to these special requirements, in all cases of application of the so-called paper guide rope, it is decisive that the paper or cardboard web can be clamped without problems when the paper manufacturing process is started and taken along from one section of the paper machine to the next section. Experience shows that one to up to 10 sections follow successively with the number of sections depending on the type of paper machine and on the quality of the paper and the cardboard. The standard rope lengths per section fluctuate between 30 m and 700 m, with the paper guide ropes being used in different rope guide system constructions (eg one-rope systems, two-rope systems or three-rope systems).

Basically, the so-called paper guide ropes textile fiber material with both fibers on a cellulose base and fibers made from organic chain polymers such as polyacrylate, polyamnide, polyester, polypropylene, polyethylene, polyvinyl alcohol or similar being used. The ropes used as paper guide ropes comprise on the one hand twisted or laid strands and on the other hand braided ropes. The braided ropes can be used as braided hollow ropes or also in the form of ropes in core/sheath designs.

Worldwide, the braided paper guide ropes have been successful over twisted ropes as a result of their high service life, their low operating stretch, their exceptional chafing and wear resistance and their simple splicing capability. However there are also some cases of design-caused relationships on paper machines where twisted ropes are given preference, as due to the more roughly structured surface of the twisted ropes advantages occur in paper web clamping over the comparatively smoother structure of braided ropes.

SUMMARY OF THE INVENTION

The object of the invention is to combine the advantages of braided ropes given above such as high service life, low operating stretch, good slicing capability and high chafing protection with the advantage of the roughly structured surface of twisted ropes so as to achieve an even better paper web clamping.

This object is solved in accordance with the invention beginning with a generic type of rope in accordance with a rope for the taking along and transferring of paper webs in the manufacture on paper machines of paper and cardboard made from round-braided textile fiber material, in which raised positions are formed over the rope circumference at regular or irregular distances by means of design measures, such as the selection of a different multiple thread count in the different running directions and/or the use of twisted or laid fiber elements, and/or the use of fibers with profiled fiber cross-sections and/or textured or crimped fiber yarns. In accordance with the invention, raised positions on the rope surface are accordingly generated in the course of the braiding process or two fiber types with different properties are deliberately used. The two measures which each solve the object singly are particularly advantageously combined.

With the present invention, a rope is provided which combines in itself on the one hand a low rope stretch by maintaining the round braiding technology and on the other hand a substantially better grip.

The generation in accordance with the invention of raised positions in the rope braiding of round-braided ropes is performed advantageously over the whole circumference of the rope at regular or irregular intervals of 0.1 to 10 cm, preferably of 1 to 5 cm. The raised positions are, for example, generated by a corresponding setting of the braiding machine parameters such as the filling of the braiding machine, selection of the lay length, etc.

Preferably, for the braiding process multifilament yarns or stable fiber yarns are used with single-fiber deniers being used from 1.6 to 30 dtex, preferably 6 to 25 dtex, and yarn deniers from 200 to 17,000 dtex, preferably 700 to 10,000 dtex. These named yarns are used advantageously either singly or plied or twisted or in combinations thereof. The named yarns can be finished with a protective twist or twisted with different impregnations, for example hydrophobic finishes, chafmg protection avivages, paint pigment finishings, etc.

Fiber materials which can be used are fibers on a cellulose base, for example cotton, hemp, regenerated cellulose fiber or similar. But it is also possible to use fibers on the basis of synthetic, thread-forming chain molecules such as, for example, polyacrylonitrile, polyamide, polyester, polyvinyl alcohol, polypropylene, polyethylene or similar. Due to their good textile-mechanical data and their sufficient chemical and temperature resistance in a paper machine environment, preferably fibers on a polyamide/polyacrylic or polyester base or on a cellulose base are used.

The above object is also solved by the use of two fiber types or fiber yams in the rope with this solution being used either alone or in combination with the features described above of the braided rope with raised positions. The generation of the above-named, design-induced raised positions can additionally be achieved by the deliberate use of fibers with profiled fiber cross-sections and/or the use of textured or crimped multifilament yarns and/or staple fiber yarns in addition to the usually used smooth multifilament yarns. Both the use of profiled fibers and of yarns with crimping or texturing leads to increased bulk volume with equal fiber titer to that of smooth yarns and so to the formation of the desired raised positions. The fibers and/or yarns must, however, be used deliberately so that predominantly the profiled fibers or the crimped multifilament yams are located on the raised positions. For the rest, the previous descriptions apply with regard to the other properties such as fiber and yarn titer, ply, twist, impregnation and selection of the chain polymers.

With regard to the profiling of the fiber cross-section, particularly synthetic fibers which during fiber manufacture thanks to a special design of the nozzle holes are given a geometrically defined cross-section shape, such as a Y, are of special importance. As regards the texturing or crimping of multifilament yarns, all currently commercially available processes can be considered as long as an increase in yam volume is effected.

BRIEF DESCRIPTION OF THE DRAWINGS

Further details and advantages of the invention can be seen from the embodiments of the present invention shown in the drawing where.

DESCRIPTION OF THE PREFERRED EMBODIMENTS

Figure 1:
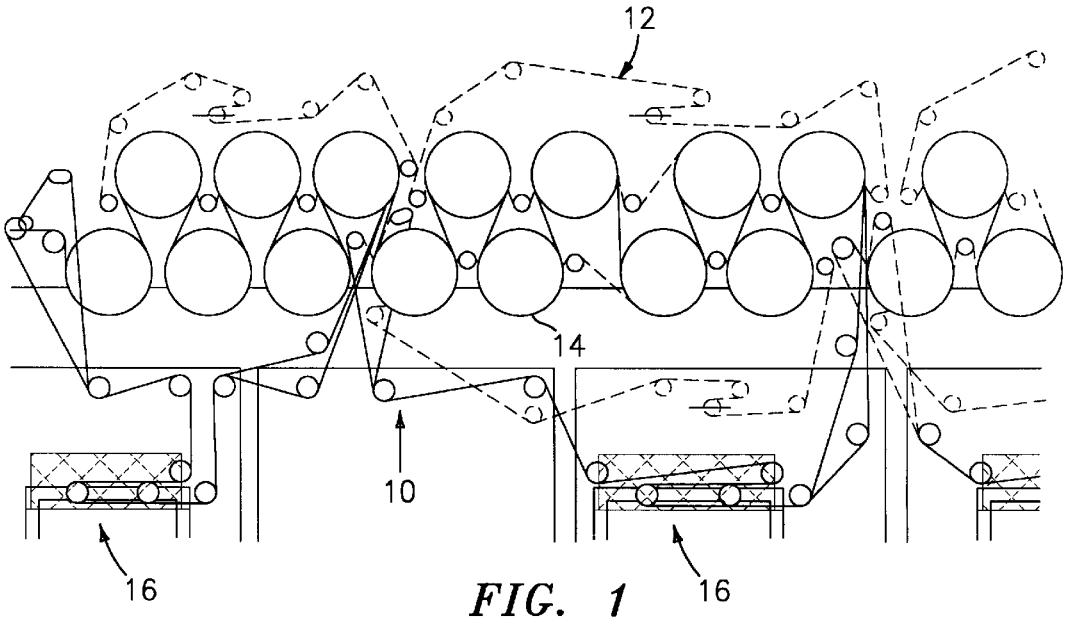
FIG. 1 shows a schematic, side view of a part of a paper machine in which the rope according to the invention can be used.

FIG. 1 shows a paper machine in which in the embodiment shown here, drying cylinders over which the paper webs are guided are represented by 14. 12 represents a felt running over the drying cylinders (broken line). The rope 10 for paper guidance is represented by an unbroken line. The rope 10 is tightened as required over tightening devices 16.

Figure 2:
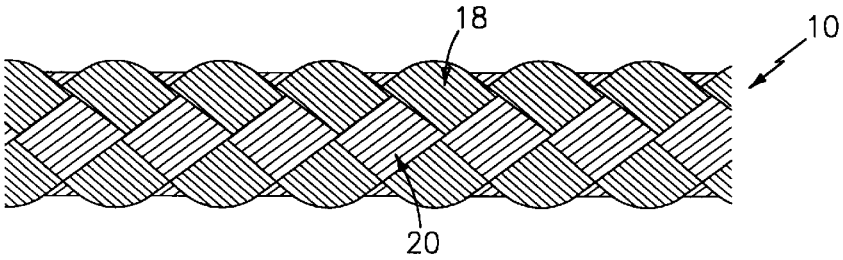
FIG. 2 illustrates a first embodiment of a rope in accordance with the invention.

FIG. 2 shows a first embodiment of the present invention. The thread count in the running direction 18 has been selected higher (16-thread) than in the opposite running direction 20 (8-thread). In the example shown here, multifilament yarns made from polyamide (PA 6) are used with the basic yarns used having the same titer. They are hydrophobically brightened and possess a twist of 140 T/m. Thanks to the different thread count, raised positions are formed at a distance of 1.8 cm with the measurement here being from the center of the raised position to the center of the next raised position. In the present embodiment, a hollow braiding has been implemented (Example 1).

Figure 3:
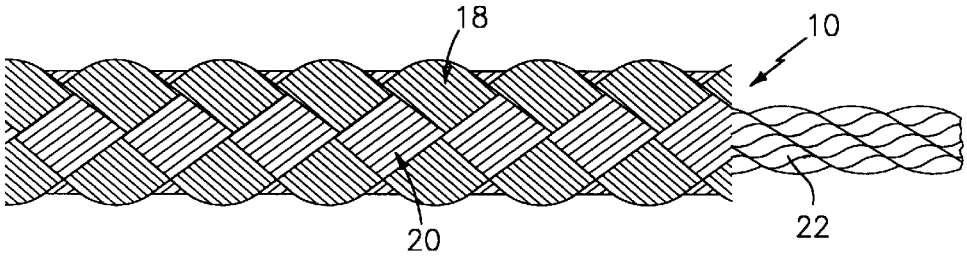
FIG. 3 illustrates a second embodiment of a rope in accordance with the invention.

In FIG. 3 another embodiment of the invention is shown in the form of a round-braided rope 10 with the thread count in the running direction 18 being higher (14-thread) than in the opposite running direction 20 (8-thread). In the embodiment shown, multifilament yarns made from polyamide (PA 66) are used for the running directions 20 and for the opposite running direction 18 staple fiber yarns made from polyacrylonitrile of the same yarn titer. The polyamride multifilament yarns are hydrophobically brightened and the polyacrylonitrile staple fiber yarns are used in non-brightened form. Furthermore, here a core/sheath design of the rope 10 has been selected with a core 22 comprising laid polyamide yarns (PA 66). Thanks to the different thread count, raised positions are formed at a distance of 1.8 cm (measured from the center of a rise to the center of the next following rise) (Example 2).

Figure 4:
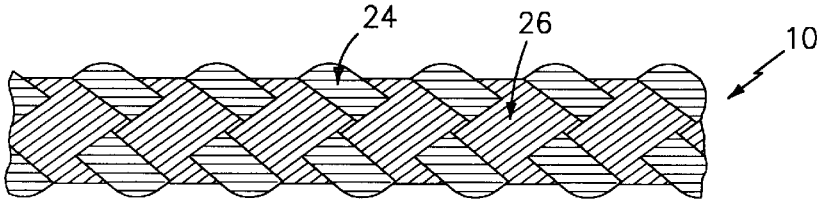
FIG. 4 illustrates a third embodiment of a rope in accordance with the invention.

FIG. 4 shows a third embodiment of the invention in the form of a round-braided rope 10 with the raised positions 24 comprising cotton yarns with a base titer of 9,000 dtex laid to form strands of 13,500 tex. The other parts 26 are formed with 8 threads from smooth multifilament yarns with a base titer of 9,000 dtex. Both yarn types are provided with a chafing protection finish including a paint pigment portion. The round braiding is constructed as a hollow rope design. The raised positions are located at distances of 1.8 cm to one another (measured from the center of a rise to the center of the following rise) (Example 3).

Another embodiment of the invention can be explained by further reference to FIG. 3 with in this embodiment the raised positions in the running direction 18 being formed of crimped multifilament yarns where the single fibers are profiled in a Y shape. The yarn titer is 4,500 dtex/16-thread. In the running direction 20 smooth multifilament yarns with the same yarn titer and the same thread count are used. The braiding is a core/sheath design with the sheath comprising polyamide 6 and the laid core 22 polyester fibers. The raised positions are located at distances of 1.8 cm (measured from the center of a rise to the next following rise) to one another (Example 4).

Figure 5:
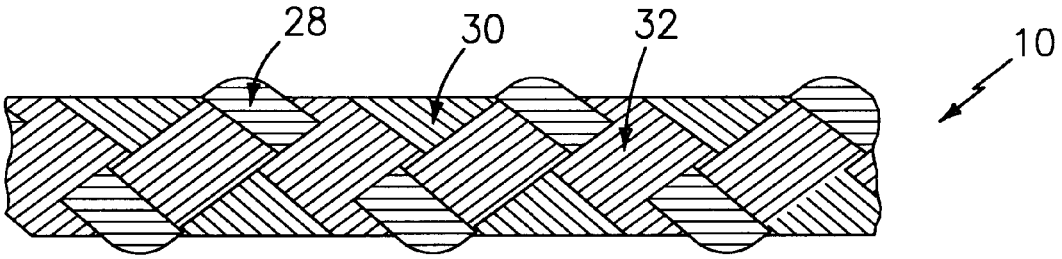
FIG. 5 illustrates a fourth embodiment of a rope in accordance with the invention.

FIG. 5 shows as another embodiment of the invention a round-braided rope with raised positions 20 where these raised positions are formed from textured multifilament yarns with a base titer of 4,500 dtex which have been laid to strands of 6,750 tex. The parts 30 and 32 comprise multifilament yarns with base titer of 4,500 dtex and have 16 threads. The raised positions are located at distances of 3.5 cm to one another (measured from the center of a rise to the center of the next rise). The round braiding is designed as a hollow rope here (Example 5).

The diameters of the ropes given above are normally 5 to 20 mm, preferably between 8 and 15 mm.

Figure 6:
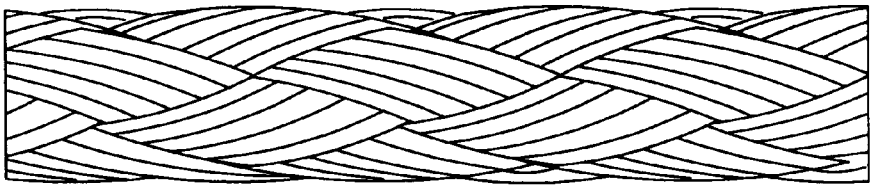
FIG. 6 (PRIOR ART)
FIG. 6 illustrates a round-braided rope according to the prior art.
Figure 7:
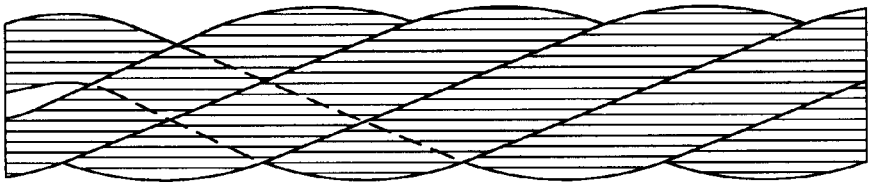
FIG. 7 (PRIOR ART)
FIG. 7 illustrates a twisted rope according to the prior art.

In FIGS. 6 and 7 paper guide ropes of the prior art are shown with FIG. 6 representing a round-braided rope (Example 6) comprising polyamide and FIG. 7 a laid rope (Example 7) comprising polyamide.

To present the improved properties of the ropes manufactured in accordance with the invention in comparison with conventional paper guide ropes such as are shown in FIGS. 6 and 7 as Examples 6 and 7, comparative trials were performed. On the one hand, the so-called grip of the ropes in accordance with the invention was determined. On the other hand, the rope stretch was measured.

To measure the grip, two ropes of the same manufacturing type are fixed at one point and held under tight tension next to each other. A sheet of paper is clamped in the gap between the two ropes and pulled through the gap on one end with a spring balance at a constant speed. The required force can be read off in grams and represents a measure for the grip. In the comparative investigations performed here, all examples were investigated under identical trial conditions. The value for example 6, i.e., the round-braided rope of the prior art, was set equal to 100%. The other values therefore refer back to this value.

To determrne the rope stretch, the rope was fixed at one point and two mark points were applied to the rope one meter apart. The rope is loaded with a predetermined weight of 80 kg and after one minute the distance between the marks is measured and the change in length which occurred determined and calculated in per cent with reference to the starting length without strain.

The following table lists the values recorded for the different Examples 1–7 (in which ropes with an outer diameter in each case of 12 mm were selected):

| Example | Grip | Rope stretch |
|---|---|---|
| 1 | 170% | 1.6% |
| 2 | 230% | 3.1% |
| 3 | 210% | 2.8% |
| 4 | 190% | 2.4% |
| 5 | 220% | 2.5% |
| 6 (Reference, braided) | 100% | 1.5% |
| 7 (Reference, twisted) | 150% | 5.6% |

The Examples 1–5 show that due to the measures according to the invention, the grip is materially improved over standard round-braided ropes (C.F. Example 6). The grip is even substantially improved over the twisted reference rope (Example 7). Despite this improvement in the grip, in all Examples in accordance with the invention 1–5, the rope stretch is not materially worse over that of the round-braided reference rope. It is in any case substantially better than the rope stretch of the twisted reference rope.

We claim:

1. A rope for carrying and transferring paper webs in manufacture of paper and cardboard on paper machines, said rope made from round-braid textile fiber, wherein said rope has raised positions formed over a substantially smooth circumference at discrete intervals and comprises at least two fiber elements or yarn elements having at least one of the following features (i)–(iii):

(i) multiple thread count of one of the fiber or yarn elements in a running direction being different from multiple thread count of another of the fiber or yarn elements in an opposite running direction;

(ii) said two fiber or yarn elements are manufactured from different polymer plastics; and (iii) at least one of said fiber or yarn elements comprises at least one of profiled fiber cross-section, textured fiber yarns, and crimped fiber yarns; and said rope additionally comprising a core comprising laid polyamide yarns, whereby grip of said rope is improved over standard rotnd-braided rope and twisted rope, with ropes stretch being maintained or improved over the standard round-braided rope and twisted rope.

2. A rope in accordance with claim 1, wherein the distances between the raised positions are between 0.1 to 10 cm as measured from a center of a raised position to a center of a next raised position.

3. A rope in accordance with claim 2, wherein the distances between the raised positions are between 1 to 5 cm.

4. A rope in accordance with claim 2, wherein the rope consists of multifilament yarns or staple fiber yarns whose single fiber titer is 1.7 to30dtex and whose yarn titer is 200 dtex to 17,000 dtex.

5. A rope in accordance with claim 4, wherein the rope consists of multifilament yarns or staple fiber yarns whose single fiber titer is 6 to 25 dtex and whose yarn titer is 700 dtex to 10,000 dtex.

6. A rope in accordance with claim 1, wherein the rope consists of multifilament yarns or staple fiber yarns whose single fiber titer is 1.7 to 30 dtex, and whose yarn titer is 200 dtex to 17,000 dtex.

7. A rope in accordance with claim 6, wherein the yarns comprising at least one of a single yarn, a plied yarn and a twisted yarn.

8. A rope in accordance with claim 7, wherein the yarns partially consist of needle-braided units.

9. A rope in accordance with claim 7, wherein the yarns are provided with at least one of the following features (i)–(iii):

(i) finished with a protective twist;

(ii) impregnated; and (iii) twisted with different impregnations.

10. A rope in accordance with claim 6, wherein the yarns are provided with one of the following features (i)–(iii):

(i) finished with a protective twist:

(ii) impregnated; and (iii) twisted with different impregnations.

11. A rope in accordance with claim 6, wherein the rope consists of multifilament yarns or staple fiber yarns whose single fiber titer is 6 to 25 dtex and whose yarn titer is 700 dtex to 10,000 dtex.

12. A rope in accordance with claim 1, wherein the textile fiber material consists of fibers on a cellulose base.

13. A rope in accordance with claim 1, wherein the textile fiber material consists of fibers on the basis of synthetic, thread-forming chain molecules.

14. A rope in accordance with claim 13, wherein the textile fiber material consists of fibers selective from the group consisting of polyamide, polyacrylic or polyester based material and mixtures thereof.

15. A rope in accordance with claim 11, wherein smooth yarns are used as one of the yarn elements.

16. A rope in accordance with claim 1, wherein said fiber or yarn elements comprise at least two of the enumerated features (i)–(iii).

17. A rope in accordance with claim 16, wherein said fiber or yarn elements comprise enumerated features (i) and (ii).

18. A rope in accordance with claim 16, wherein said fiber or yarn elements comprise the enumerated features (i) and (iii).

19. A rope in accordance with claim 1, wherein said discrete intervals are regular intervals.

20. A rope in accordance with claim 1, wherein said discrete intervals are irregular intervals.

21. A rope in accordance with claim 1, wherein said profiled fibers or said crimped multifilament yarns are used such that the profile fibers or crimped multi-filament yarns are predominantly located upon said raised positions.

22. A rope in accordance with claim 1, wherein said crimped yarns are multi filament yarns and are utilized such that single fibers thereof are profiled in a Y shape.

23. A rope in accordance with claim 1, wherein said yarns are comprising multifilament yarns made from polyamide in the running direction having a higher thread count than staple fibers yarns made from polyacrylonitrile in the opposite running direction.

24. A rope in accordance with claim 1, wherein the fiber yarns are textured by being coated or impregnated with at least one of hydrophobic finish, chafing protection or paint pigment finishing.

* * * * *